US005711597A

United States Patent [19]

Unno

[11] Patent Number: 5,711,597

[45] Date of Patent: Jan. 27, 1998

[54] LAMP BULB SECURING STRUCTURE

[75] Inventor: Masayoshi Unno, Shizuoka, Japan

[73] Assignee: Koito Manufacturing Co., Ltd., Tokyo, Japan

[21] Appl. No.: 659,241

[22] Filed: Jun. 5, 1996

[30] Foreign Application Priority Data

Jun. 21, 1995 [JP] Japan ..... 7-178258

[51] Int. Cl.[6] ..... H01R 33/00

[52] U.S. Cl. ..... 362/226; 362/61; 362/444; 362/457

[58] Field of Search ..... 362/61, 226, 374, 362/375, 435, 436, 438, 439, 440, 444, 457

[56] References Cited

U.S. PATENT DOCUMENTS

| | | | |
|---|---|---|---|
| 4,670,822 | 6/1987 | Baker | 362/226 |
| 4,811,178 | 3/1989 | Ernst et al. | 362/226 |
| 4,872,096 | 10/1989 | Montet | 362/226 |
| 4,890,202 | 12/1989 | Blanche | 362/61 |
| 4,922,388 | 5/1990 | Freudenreich | 362/61 |
| 5,186,535 | 2/1993 | Yokoyama | 362/226 |

FOREIGN PATENT DOCUMENTS

| | | | |
|---|---|---|---|
| 1391962 | 2/1965 | France | 362/374 |
| 813619 | 5/1959 | United Kingdom | 362/226 |

*Primary Examiner*—Alan Cariaso

*Attorney, Agent, or Firm*—Sughrue, Mion, Zinn, Macpeak & Seas, PLLC

[57] ABSTRACT

A lamp bulb securing structure which includes a set spring for urging a metal piece of a lamp bulb against a periphery member of a lamp bulb mounting hole to secure, wherein a tip end part of the set spring is hooked on an engagement member formed on the periphery member of the lamp bulb mounting opening, a part of the set spring urges against the metal piece of the lamp bulb under the condition where the tip end part is hooked on the engagement member, the tip end part is bent inward, and an end of the bent part is hooked on the engagement member.

19 Claims, 5 Drawing Sheets

LAMP BULB SECURING STRUCTURE

BACKGROUND OF THE INVENTION

1. Field of the Invention

The present invention relates to a lamp bulb securing structure for securing a lamp bulb serving as a light source to a lamp. Bore particularly, the invention relates to a lamp bulb securing structure for securing a lamp bulb by means of a resilient force of a set spring.

2. Related Art

FIG. 5 is a side sectional view showing a conventional lamp bulb securing structure of this type. As shown in FIG. 5, a lamp body 1 and a lens 2 define a lamp chamber in which a reflector 3 is installed. The reflector 3 is provided with a lamp bulb mounting opening 4 through which a lamp bulb 5 is inserted to be secured. The securing operation for the lamp bulb 5 takes place through an opening 6 formed in a back surface of the lamp body 1.

FIG. 6 is an enlarged perspective view showing the lamp bulb securing structure of the lamp bulb 5 with respect to the reflector 3. The reflector 3 is formed integrally with an essentially cylindrical mounting metal member 9 surrounding the lamp bulb mounting opening 4. During assembly, a metal piece flange 7 formed at a part of a metal piece of the lamp bulb 5 comes into abutment against the mounting metal member 9, and a set spring 8A formed of a wire material having a resilient force comes into contact resiliently to the metal piece flange 7 from behind thereof, so that the metal piece flange 7 is resiliently urged against the mounting metal member 9 by means of the resilient force of the set spring 8A to thereby secure the lamp bulb 5 to the reflector 3.

In this case, the set spring 8A is bent to be U-shaped having one side part longer than the other, and a center bending part 8Aa hooks on a hook member 10 formed on the mounting metal member 9. In the set spring 8A, a short side part 8Ab of the set spring 8A contacts to the metal piece flange 7, a long side part is formed with a bending part serving as an operation part 8Ac, and a tip end part 8Ad of the long side part hooks on a hook like engagement member 11 formed at a part of the other circumference of the mounting metal member 9. An intermediate part 8Ae of the long side part is bent toward the lamp bulb so that it urges the metal piece flange 7.

The end of the engagement member 11 directs down, and by bending the tip end part 8Ad of the long side part of the set spring 8A against the elastic force thereof, the intermediate part 8Ae comes into contact resiliently to the back surface of the metal piece flange 7 which is then urged against the mounting metal member 9 to hold it, so that the lamp bulb 5 is secured to the lamp bulb mounting opening 4.

However, with the conventional securing structure as described above, as shown in FIG. 6, the operation part 8Ac formed on the long side part or the tip end part 8Ad of the set spring 8A is operated by finger when the set spring 8A is hooked on the engagement member 11. During this operation, since the operation part 8Ac must be formed limitedly within a dimension of diameter of the mounting metal member 9, which is small regional area, the finger is strongly urged to cause a pain. On the other hand, when the tip end part 8Ad is operated, the finger may be injured by the sharp tip end part 8Ad as it Is not treated after cutting out the wire member. Further, if the finger touches the engagement member 11, the finger may be injured by the engagement member 11 which is formed by means of the blanking processing. Moreover, if the tip end part 8Ad of the set spring 8A interferes with a connection code 12 drawn from the lamp bulb metal piece, the outer sheath may be damaged to cause the undesirable electrical short or a fire in the worst case.

In view of the foregoing drawbacks, some arrangements have been proposed in which the tip end part 8Ad is bent back so that the sharp tip end does not protrude. However, if the bent back amount is not sufficient or appropriate, the above problems may still occur. On the other hand, generally, since various kinds of components or parts are disposed on the lamp body at appropriate portions adjacent the lamp bulb, the length of the set spring 8A which is allowed to project from the lamp bulb mounting opening 4 in the outer diameter direction thereof is so limited that the length of the long side part of the set spring 8A cannot be elongated more. Accordingly, the length of the tip end part which projects from the engagement member is not sufficient, so that the operation by finger becomes further worse.

SUMMARY OF THE INVENTION

In view of the foregoing problems accompanying the conventional or the proposed structure, it is an object of the present invention to provide a lamp bulb securing structure capable of improving the workability during attaching and detaching operations for a set spring with the lamp bulb. Another object of the invention Is to provide a lamp bulb securing structure capable of preventing finger from being injured and preventing outer sheath of connection code from being damaged.

The above and other objects can be achieved by a provision of a lamp bulb securing structure which, according to the present invention, includes a set spring for urging a metal piece of a lamp bulb against a periphery member of a lamp bulb mounting hole to secure the lamp bulb, wherein a tip end part of the set spring is hooked on an engagement member formed on the periphery member of the lamp bulb mounting opening, a part of the set spring urges against the metal piece of the lamp bulb under the condition where the tip end part is hooked on the engagement member, the tip end part is bent inward, and a peak part of the bending part is hooked on the engagement member.

According to the present invention, since the tip end part of the set spring is bent inward and the peak part of the bending part is hooked, when the set spring is bent to be hooked on the engagement member, and when the outer part of the tip end part is operated by a finger, the finger would not touch the sharp tip end part of the set spring. Further, the tip end part of the set spring does not interfere with the connection code. Therefore, the injury of finger and the damage of the outer sheath of the connection code can be effectively avoided. Further, since it is not necessary to depress the tip end part of the set spring further from the engagement member but the finger can operate the set spring in a wide regional area, the workability during the lamp bulb securing operation can be effectively improved.

DESCRIPTION OF THE PREFERRED EMBODIMENTS

The preferred embodiment of the present invention will now be described with reference to accompanying drawings.

Figure 1:
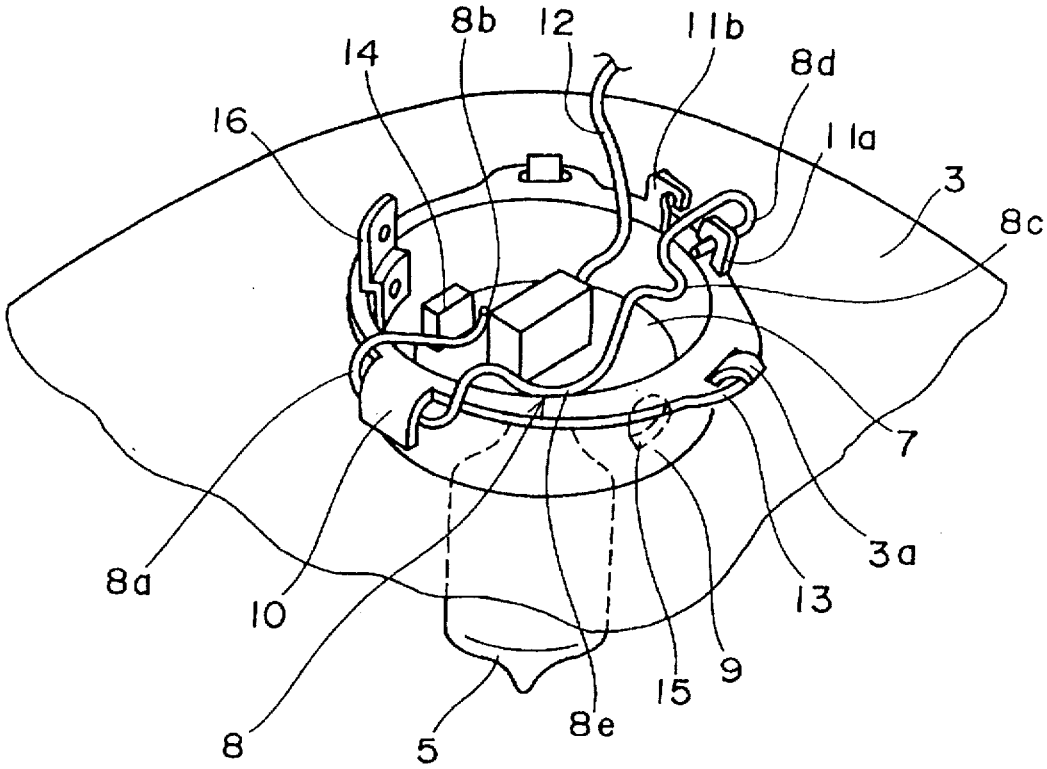
FIG. 1 is a perspective view showing a first embodiment of a lamp bulb securing structure according to the present invention.
Figure 3:
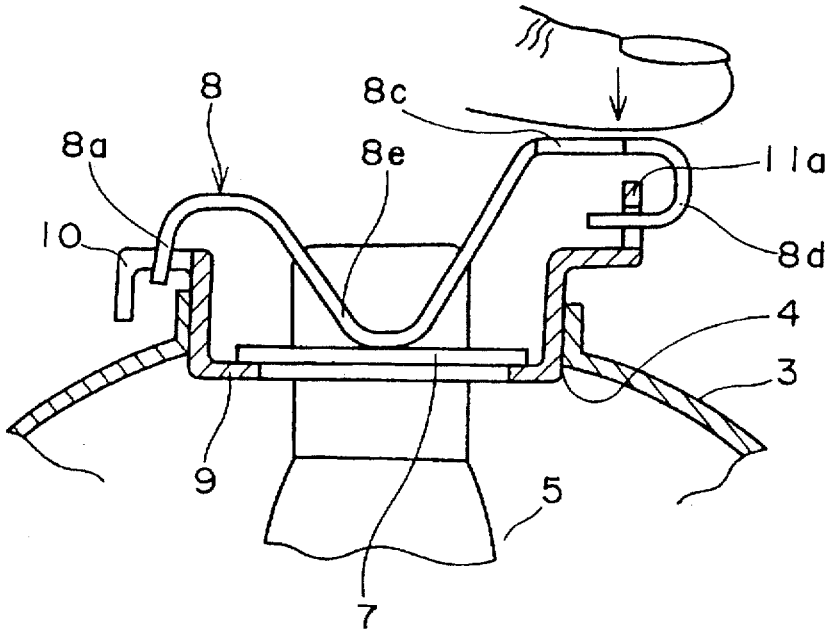
FIG. 3 is a sectional view of the lamp bulb securing structure of the invention for explaining an operation to hook a set spring.
Figure 2:
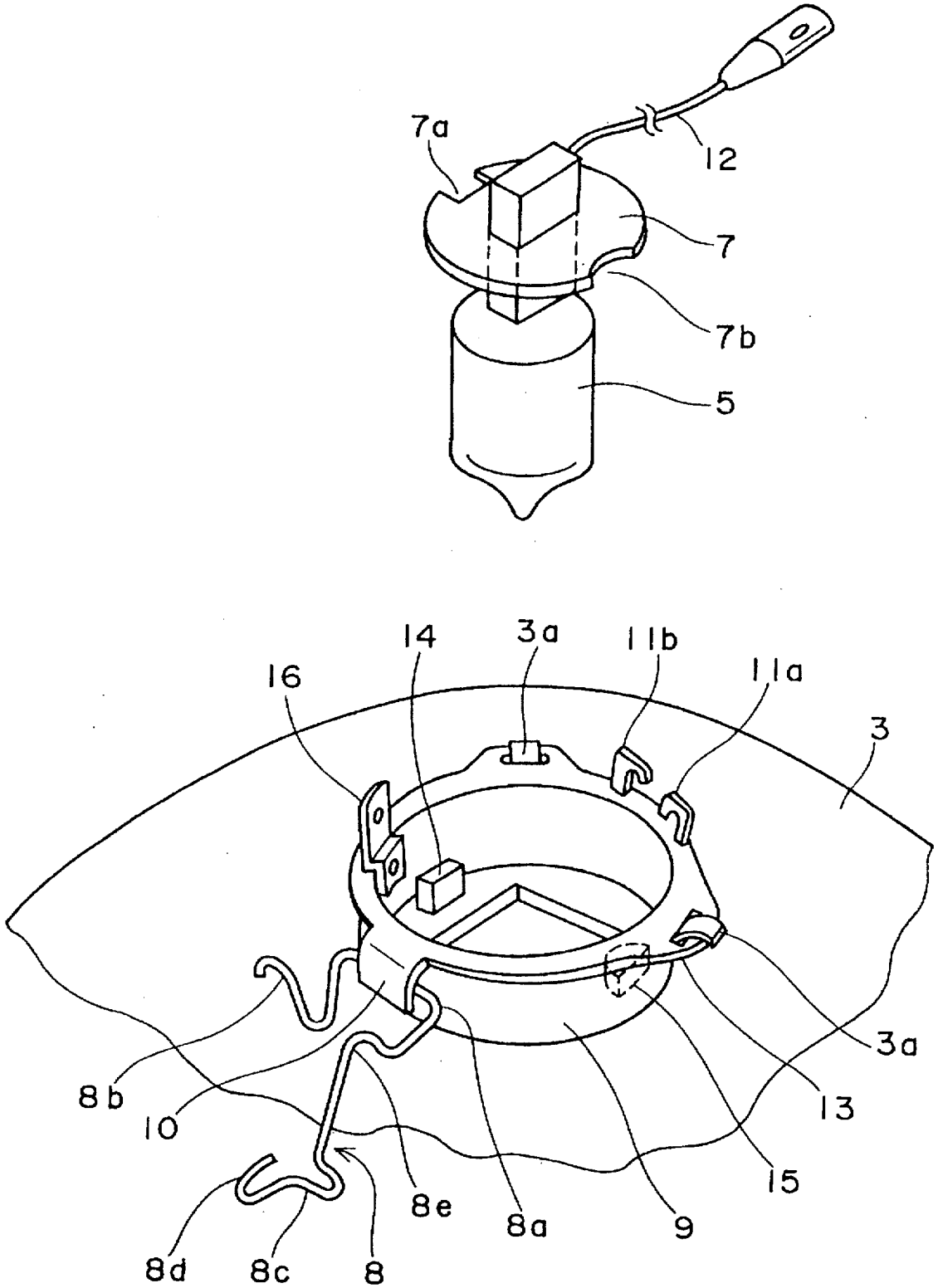
FIG. 2 is a partially exploded perspective view of the lamp bulb securing structure shown in FIG. 1.
Figure 5:
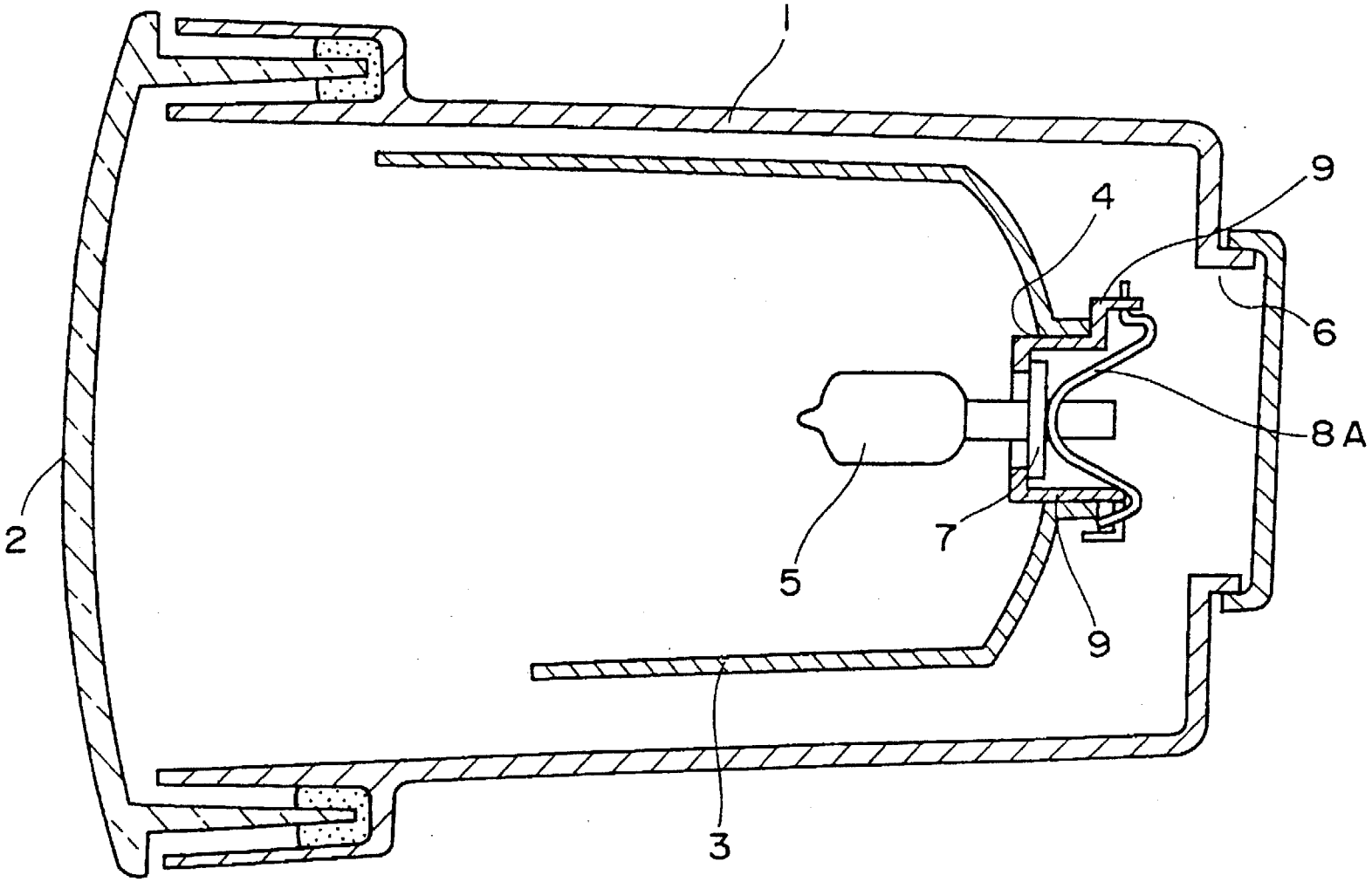
FIG. 5 is a sectional view of a lamp to which the present invention is applied.
Figure 6:
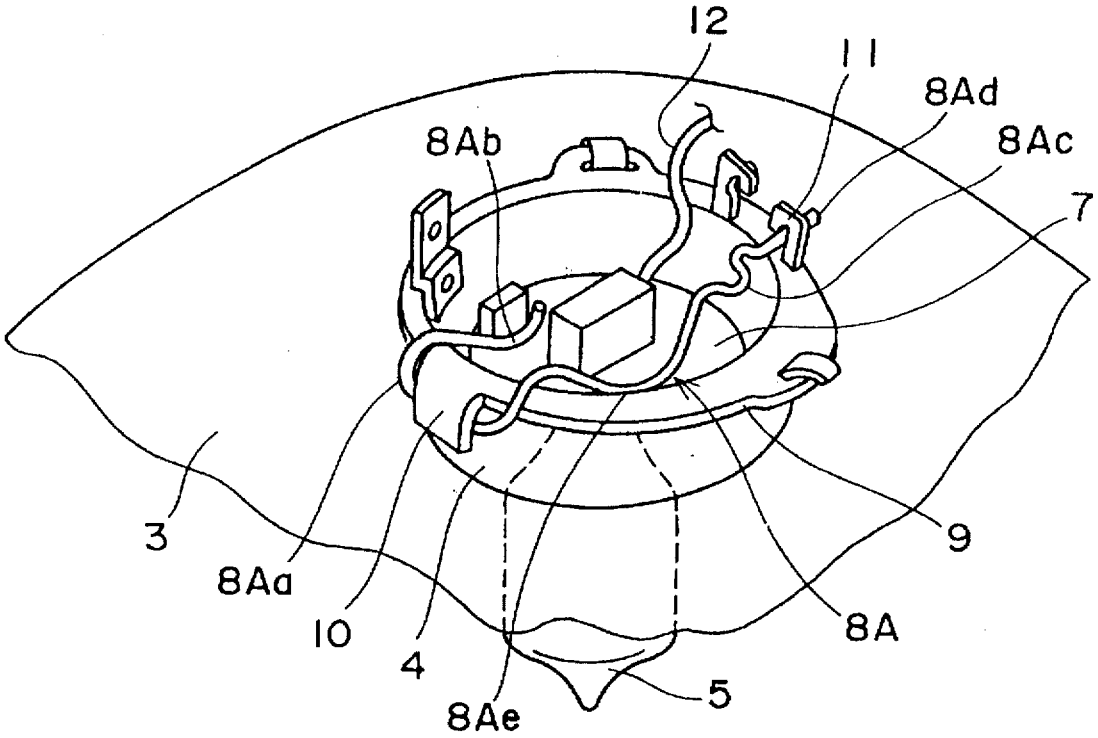
FIG. 6 is a perspective view showing a conventional lamp bulb securing structure.
Figure 7:
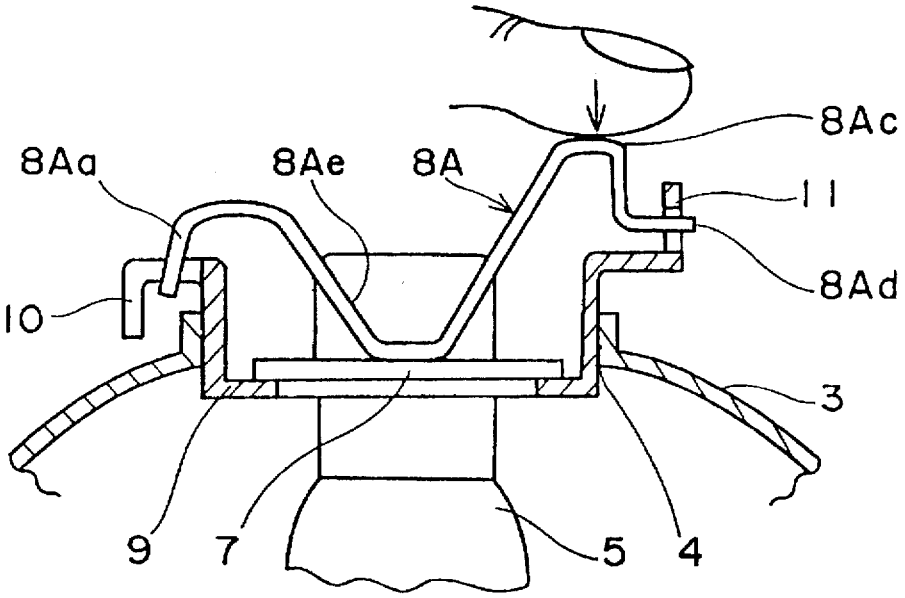
FIG. 7 is a sectional view of the conventional lamp bulb securing structure for explaining an operation to hook a set spring.

FIG. 1 is a perspective view showing a first embodiment of the invention, FIG. 2 is a partially exploded perspective view of FIG. 1, and FIG. 3 is a sectional view of the lamp bulb securing structure of the invention for explaining an operation to hook a set spring. The first embodiment of the present invention is applied to a structure for securing a lamp bulb 5 to a reflector 3 installed within a lamp body 1 as shown in FIG. 5.

The reflector 3 is provided with a lamp bulb mounting opening 4 to which an essentially annular mounting metal member 9 is attached integrally in such a manner that tongue pieces 3*a* formed on the reflector insert in a plurality of slits 13 formed in a periphery member of the mounting metal member 9, and then the tongue pieces 3*a* are bent to be caulked therewith. An engagement member 10 extends from a part of the periphery member of the mounting metal member 9. An intermediate part 8*a*, which is described in detail hereinafter, of a set spring 8 hooks on the engagement member 10. On the other hand, at a part of the periphery member of the mounting metal member 9 opposite to the engagement member 10 in the radius direction thereof, there are provided a pair of hook members 11*a*, 11*b* facing each other. According to the first embodiment, one hook member 11*a* performs as an engagement member for hooking thereon a tip end part of a long side part of the set spring 8.

The mounting metal member 9 is also formed with a rectangular projection 14 at one part of an inner bottom thereof and a half-cylindrical projection 15 at the other part of thereof opposite to the rectangular projection 14. Both the rectangular projection 14 and the half-cylindrical projection 15 serve as positioning members for the lamp bulb 5. A reference numeral 16 represents an earth terminal which is connected to the mounting metal member 9 by caulking processing.

The lamp bulb 5 is provided integrally with a metal piece flange 7, which is a circular plate. The metal piece flange 7 of the lamp bulb 5 if fitted into the inner bottom of the mounting metal member 9. The metal piece flange 7 is formed with a rectangular cut-out portion 7*a* and a semicircular cut-out portion 7*b* opposite to each other which engage with the rectangular projection 14 and the half-cylindrical projection 15, respectively, so that the lamp bulb 5 is attached to the mounting metal member 9 in a predetermined direction. As shown in the figures, a lamp bulb code 12 is drawn from the metal piece of the lamp bulb 5.

The set spring 8 is formed by a wire material having resiliency and bent to be essentially U-shaped in plan view, which has one side part longer than the other side. An intermediate bending part 8*a* loosely hooks on the engagement member 10 of the mounting metal member 9. The engagement member 10 is formed by bending a tongue piece integrally formed with the mounting metal member 9 perpendicularly in the thickness direction thereof, and the bending part 8*a* of the set spring 8 hooks on the engagement member 10 so that the set spring 8 is pivotable around the engagement member 10 serving as a fulcrum.

On the other hand, a tip end part 8*b* of the short side part of the set spring 8 is bent downward in FIG. 1. The long side part is formed with a depressing part 8*e* at an intermediate region thereof. The further end part of the depressing part 8*e* is bent up and again bent down to form an operation part 8*c* which is perpendicular to the other part of the set spring 8. Further end part of the long side part is bent down inwardly to have a lateral U-shape, and a peak part 8*d* of the U-shaped part hooks on the hook member 11*a* of the mounting metal member 9.

With the structure described above, when the lamp bulb 5 is to be secured to the reflector 3, the set spring 8 hooks on the hook member 10 so that the set spring 8 pivotally moves around the hook member 10 as a fulcrum to be away from the position of the mounting metal member 9 and, under the condition, the lamp bulb 5 is inserted in the lamp bulb mounting opening 4 and then the metal piece flange 7 fits into the inner bottom of the mounting metal member 9. When the metal piece flange 7 fits, the lamp bulb 5 is positioned in the predetermined direction by engaging the rectangular and half-cylindrical projections 14 and 15 with the cut-out portions 7*a* and 7*b*, respectively.

Afterwards, as shown in FIG. 3, the set spring 8 is rotated to come into contact to the mounting metal piece. Then, an outer surface part of the operation part 8*c* formed by bending the long side part is depressed by a finger so that the long side part of the set spring 8 is resiliently deformed downward. At the same time, the tip end part 8*b* of the short side part is also resiliently deformed downward to come into abutment against the metal piece flange 7 so that the metal piece flange 7 is urged against the mounting metal member 9. Under this condition, the operation part 8*c* and the peak part 8*d* are slightly slid laterally to thereby hook on the hook member 11*a*. By the operation, the set spring 8 is then held being hooked whereas the depressing part 8*e* bent downward urges the metal piece flange 7 against the mounting metal member 9 from the back side, so that the lamp bulb 5 is held being secured to the reflector 3.

When the lamp bulb 5 is to be exchanged, the peak part 8*d* of the set spring 8 is released from the hooking condition by depressing down the outer surface part of the operation part 8*c* of the long side part and sliding the same laterally, so that the peak part 8*d* is removed from the hook member 11*a* of the mounting metal member 9. Afterwards, when the depressing force of the finger is released, the set spring 8 jumps up by its own spring force, so that the urging force against the metal piece flange 7 is released. Then, when the set spring 8 is rotated around the hook member serving as a fulcrum to a position distanced from the bulb mounting opening 4, and the back side of the bulb mounting opening 4 is released thereby to allow the lamp bulb 5 to be detached. A new lamp bulb is secured to the reflector as the same operation as described above.

According to the set spring 8 of the present invention, since the sharp tip end of which is bent inward, finger would hardly touch the sharp tip end. Thus, the possibility of injuring the finger during the securing operation can be avoided. In addition, because the sharp tip end of the set spring 8 is prevented from interfering with the bulb code 12, the outer sheath of the bulb code 12 is not damaged. Further, according to the present invention, the portion where the finger contacts to the set spring 8 has a wide regional area containing the operation part 8*c* and the peak part 8*d*. Therefore, a so-called area pressure of the set spring 8 with the finger can be dispersed and the finger would not have a pain. For these reasons, the operation of bending the set spring 8 becomes easily and the lamp bulb can be readily exchanged.

Figure 4:
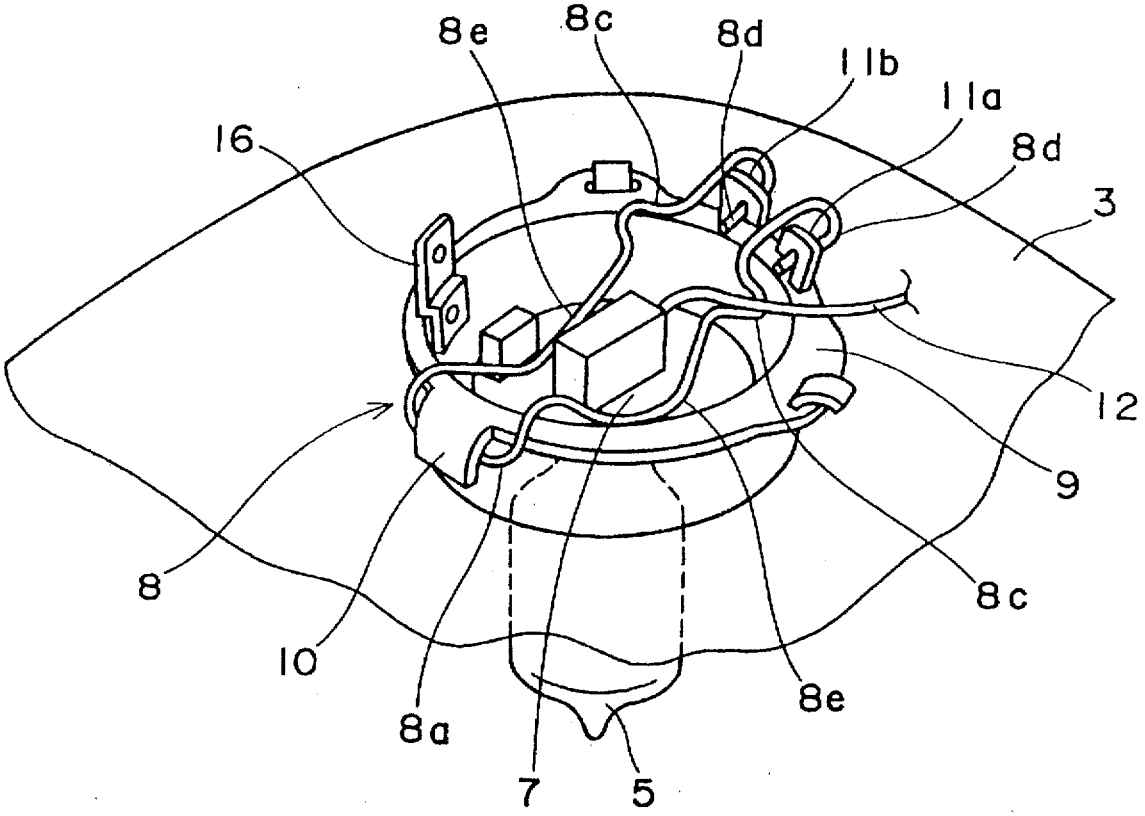
FIG. 4 is a perspective view showing a second embodiment of the present invention.

FIG. 4 is a perspective view showing a second embodiment of the invention, which corresponds to FIG. 1 showing the first embodiment. In the second embodiment, a set spring 8 is formed by bending an intermediate part 8*a* to thereby have a symmetrical both side parts. Each of the both side parts is formed with the operation part 8*c*, peak part 8*d* and depressing part 8*e*. By hooking the peak parts 8*d* on a pair of the hook members 11*a*, 11*b* formed on the mounting metal member 9, respectively, both the depressing parts 8*e* urge to support the metal piece flange 7. According to the second embodiment of the present invention, since the metal piece flange 7 is depressed by the two parts of the set spring 8, the securing reliability of the lamp bulb can be enhanced.

The embodiments of the invention as described above are merely examples, and the invention is not limited thereto or thereby. For example, the shape of the set spring, the shape and the structure of the engagement member and the hook member can be modified if desired. Further, the preferred embodiments described above show merely an example of the structure in which the mounting metal member is attached on the reflector. However, the reflector itself may be formed integrally with the hook member and the engagement member. In addition, the present invention can be also applied to a case where a lamp bulb is attached to a lamp body, rather than a reflector.

According to the present invention, since the tip end part of the set spring is bent inward and the end of the bent part is hooked, when the set spring is bent to be hooked on the engagement member, the outer part of the tip end part is operated by a finger which does not touch the sharp tip end part of the set spring. Further, the tip end part of the set spring does not interfere with the connection code. Therefore, the injury of finger and the damage of the outer sheath of the connection code can be avoided. Further, since it is not necessary to further depress the tip end part of the set spring from the engagement member and the finger can operate the set spring in a wide regional area, the workability can be effectively improved.

Further, according to the present invention, the part where the finger contact to the set spring 8 has a wide region containing the operation part 8*c* and the peak part 8*d*. Therefore, a so-called area pressure of the set spring 8 with the finger can be dispersed and the finger would not have a pain. For these reasons, the operation of bending the set spring 8 becomes easily and the lamp bulb can readily be exchanged.

It should be understood that the form of the invention herein shown and described is to be taken as a preferred example of the invention and that various changes in the shape, size and arrangement of parts may be resorted to without departing from the spirit of the invention or the scope of the subjoined claims.

What is claimed is:

1. A lamp bulb securing device comprising:

an annular bulb mounting member to which a lamp bulb fits, said bulb mounting member comprising a first hook member and a second hook member disposed at opposite side of said first hook member; and a set spring formed by a wire having a resilient force comprising:

an intermediate part hooking on said first hook member of said bulb mounting member;

a tip end part constituted by a distal end of said wire, which is bent inward to form a curved peak part with said distal end extending toward an inside of said bulb mounting member, said peak part hooking on said second hook member of said bulb mounting member;

a depressing part disposed between said intermediate part and said tip end part, said depressing part urging the lamp bulb against said bulb mounting member; and an operation part disposed between said intermediate part and said tip end part, wherein during installation, a user presses against said operation part to laterally displace said peak part so as to engage said peak part with said second hook member.

2. The lamp bulb securing device according to claim 1, wherein said set spring is formed by bending a single wire material.

3. The lamp bulb securing device according to claim 1, wherein said second hook member of said bulb mounting member comprises one engagement hook.

4. The lamp bulb securing device according to claim 1, wherein said second hook member of said bulb mounting member comprises two engagement hooks.

5. The lamp bulb securing device according to claim 1, wherein said bulb mounting member is secured to a bulb mounting opening formed in a reflector of the lamp.

6. The lamp bulb securing device according to claim 1, wherein said bulb mounting member is secured to a bulb mounting opening formed in a lamp body of the lamp.

7. The lamp bulb securing device according to claim 1, wherein said first hook member and said second hook member are formed by bending tongue parts of said bulb mounting member.

8. The lamp bulb securing device according to claim 1, wherein said bulb mounting member comprises a first projection and a second projection having a different contour from said first projection, and the lamp bulb comprises a first cut-out and a second cut-out engageable with said first and second projections, respectively.

9. The lamp bulb securing device according to claim 8, wherein said first cut-out is rectangular and said second cut-out is semicircular.

10. A set spring having a resilient force for securing a lamp bulb to a bulb mounting member having a first hook member and a second hook member, the set spring being formed of a wire and comprising:

an intermediate part hooking on said first hook member of said bulb mounting member;

a tip end part constituted by a distal end of said wire, which is bent inward to form a curved peak part with said distal end extending toward an inside of said bulb mounting member, said peak part hooking on said hook member of said bulb mounting member;

a depressing part disposed between said intermediate part and said tip end part, said depressing part urging the lamp bulb against said bulb mounting member; and an operation part disposed between said intermediate part and said tip end part, wherein during installation, a user presses against said operation part to laterally displace said peak part so as to engage said peak part with said second hook member.

11. The set spring according to claim 10, wherein the set spring is formed by bending a single wire material.

12. The set spring according to claim 10, wherein said second hook member of said bulb mounting member comprises one engagement hook.

13. The set spring according to claim 10, wherein said second hook member of said bulb mounting member comprises two engagement hooks.

14. The set spring according to claim 10, wherein said bulb mounting member is secured to a bulb mounting opening formed in a reflector of the lamp.

15. The set spring according to claim 10, wherein said bulb mounting member is secured to a bulb mounting opening formed in a lamp body of the lamp.

16. The set spring according to claim 10, wherein said first hook member and said second hook member are disposed at opposite side to each other on said bulb mounting member.

17. The set spring according to claim 10, wherein said first hook member and said second hook member are formed by bending tongue parts of said bulb mounting member.

18. The set spring according to claim 10, wherein said bulb mounting member comprises a first projection and a second projection having a different contour from said first projection, and the lamp bulb comprises a first cut-out and a second cut-out engageable with said first and second projections, respectively.

19. The set spring according to claim 18, wherein said first cut-out is rectangular and said second cut-out is semicircular.

* * * * *